US006874917B2

(12) United States Patent
Spada

(10) Patent No.: US 6,874,917 B2
(45) Date of Patent: Apr. 5, 2005

(54) ADJUSTABLE DEVICE FOR SUPPORTING A LIGHTING ELEMENT OF A LIGHTING FIXTURE

(75) Inventor: Orazio Spada, Opera (IT)

(73) Assignee: Metal Spot, S.p.A. (IT)

( * ) Notice: Subject to any disclaimer, the term of this patent is extended or adjusted under 35 U.S.C. 154(b) by 307 days.

(21) Appl. No.: 10/224,573

(22) Filed: Aug. 21, 2002

(65) Prior Publication Data

US 2004/0037083 A1 Feb. 26, 2004

(51) Int. Cl.[7] ..... F21V 19/02

(52) U.S. Cl. ..... 362/418; 362/391; 362/147; 362/405

(58) Field of Search ..... 362/391, 388, 362/396, 403, 405, 407, 418, 406, 147, 287

(56) References Cited

U.S. PATENT DOCUMENTS 5,255,173 A * 10/1993 Schonbek ..... 362/405
5,329,434 A * 7/1994 Hong ..... 362/238
6,371,632 B1 * 4/2002 Lavy ..... 362/406
2002/0145877 A1 * 10/2002 Johnson ..... 362/406
2003/0099109 A1 * 5/2003 Wu ..... 362/370

* cited by examiner

*Primary Examiner*—Y. My Quach-Lee
*Assistant Examiner*—Peggy A. Neils
(74) *Attorney, Agent, or Firm*—Hall, Myers, Vande Sande & Pequignot

(57) ABSTRACT

There is provided an adjustable device for supporting a lighting element of a lighting fixture, and which provides for adjusting the spatial configuration of the lighting fixture by adjusting, in particular, the position of a lamp-holder with respect to a supporting body; the lamp-holder is connected to the supporting body by an electric cable, and by a flexible conducting first rod secured at opposite ends to the lamp-holder and the supporting body; a flexible second rod is fixed to the lamp-holder and to the supporting body by respective attachments; and adjusting means are provided for adjusting the length of the second rod to selectively adjust the distance between the respective attachments and, therefore, the position of the lamp-holder with respect to the supporting body.

6 Claims, 1 Drawing Sheet

ADJUSTABLE DEVICE FOR SUPPORTING A LIGHTING ELEMENT OF A LIGHTING FIXTURE

The present invention relates to an adjustable device for supporting a lighting element of a lighting fixture, and which is particularly suitable for chandeliers comprising a number of light sources.

BACKGROUND OF THE INVENTION

Chandeliers are known in which a number of light sources define respective lighting elements arranged in a given configuration, e.g. radially about a central axis. The lighting elements are normally supported on respective arms fixed permanently to a central supporting body, and cannot be rearranged, in particular with respect to the supporting body, without considerable difficulty.

SUMMARY OF THE INVENTION

It is an object of the present invention to provide an adjustable device for supporting a lighting element of a lighting fixture, designed to eliminate the drawbacks of known systems, and which in particular provides for fast, easy adjustment of the distance and position of the lighting element with respect to a supporting body.

According to the present invention, there is provided an adjustable device for supporting a lighting element of a lighting fixture, comprising a supporting body; a lamp-holder; mechanical connecting means for connecting the lamp-holder to the supporting body, and having respective attachments for connection to the lamp-holder and the supporting body; and first and second conducting means between the lamp-holder and the supporting body; the device being characterized in that said first conducting means comprise a flexible conducting rod, and said second conducting means are wire conducting means; and by also comprising adjusting means for adjusting the length of said mechanical connecting means to selectively adjust the distance between said respective attachments and, therefore, the position of the lamp-holder with respect to the supporting body.

The device according to the invention is therefore extremely cheap and easy to make and assemble, and provides for adjusting the spatial configuration of the lighting fixture—namely, the position of the lamp-holder with respect to the supporting body—quickly and easily, and with no particularly complicated or expensive components required.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
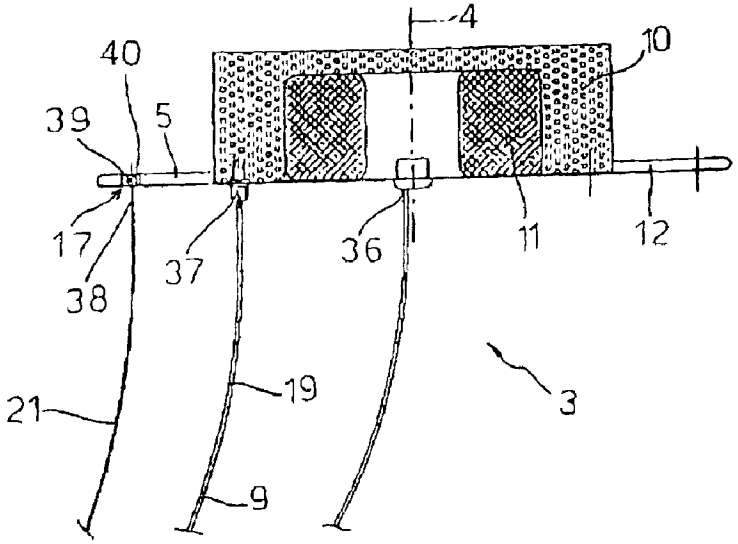
FIG. 1 shows a schematic section of an adjustable supporting device in accordance with the invention.
Figure 2:
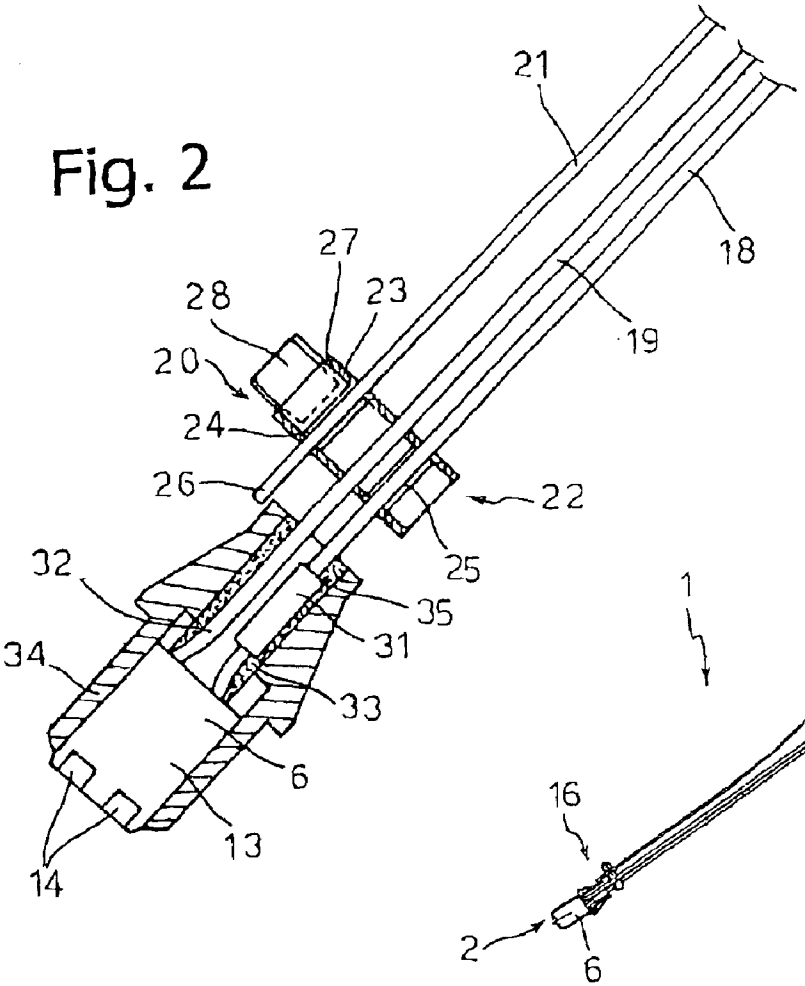
FIG. 2 shows a larger-scale schematic detail of the FIG. 1 device.

Number 1 in the accompanying drawings indicates as a whole an adjustable device for supporting a lighting element 2 of a lighting fixture 3, which may be of any known type, e.g. a chandelier comprising a number of lighting elements 2 (only one shown in FIG. 1 for the sake of simplicity) arranged radially about a central axis of symmetry 4.

Device 1 comprises a supporting body 5 of any shape; a known lamp-holder 6 defining a corresponding lighting element 2; mechanical connecting means 7 for connecting lamp-holder 6 to supporting body 5; and first and second conducting means 8, 9 between lamp-holder 6 and supporting body 5. In the non-limiting example shown in FIG. 1, supporting body 5 comprises a casing 10 housing known electric components 11, and a plate 12; lamp-holder 6 is of known type, e.g. comprising a shell 13 of insulating polymer material, and two terminals 14 for connection to a light source (not shown); mechanical connecting means 7 comprise respective attachments 16, 17 for connection to lamp-holder 6 and supporting body 5; first conducting means 8 comprise a first flexible conducting rod 18 defined, for example, by a metal cable of suitable diameter; and second conducting means 9 are wire conducting means comprising an electric cable 19 with a known insulating sheath.

Here and hereinafter, "rod" is intended to mean any elongated body much smaller crosswise than in length, and which is flexible, i.e. can be deformed elastically into a substantially straight configuration or any of a number of deformed, even sharply bent, configurations.

Device 1 also comprises adjusting means 20 for adjusting the length of mechanical connecting means 7 to selectively adjust the distance between attachments 16 and 17 and, therefore, the position of lamp-holder 6 with respect to supporting body 5.

More specifically, mechanical connecting means 7 comprise a second flexible rod 21, e.g. also defined, like rod 18, by a small-diameter metal cable; adjusting means 20 comprise fastening means 22 for fastening rod 18 to rod 21, and in turn comprising a hollow cylinder 23 made of metal material and having parallel radial through holes 24, 25 respectively defining a fastening seat for a longitudinal end 26 of rod 21, and a sliding seat for rod 18; and, at one axial end 27, cylinder 23 has a threaded pin 28 movable axially inside cylinder 23 to grip rod 21 inside fastening hole or seat 24.

Rod 18 and electric cable 19 are connected electrically in known manner to lamp-holder 6 by respective parallel, side by side connecting ends 31, 32; device 1 comprises electric insulating means 33 surrounding connecting ends 31, 32, and which, in the example shown, comprise an insulating sleeve 33 preferably made of relatively elastic polymer material, interference-fitted to connecting ends 31, 32, and resting axially on shell 13 of lamp-holder 6, on the opposite side to connecting terminals 14; and a cap 34, e.g. made of metal material, is fitted radially outwards to lamp-holder 6, and has an inner seat 35 housing insulating sleeve 33.

Rod 18 and electric cable 19 are also connected electrically in known manner, by respective ends 36, 37 opposite connecting ends 31, 32, to electric components 11 housed in casing 10; and rod 21 is fixed to plate 12 of supporting body 5 by a longitudinal end 38 opposite longitudinal end 26 and defining attachment 17. More specifically, longitudinal end 38 comprises a spherical head 39 inserted inside a seat 40 formed in plate 12 and from which rod 21 extends. Attachment 16, on the other hand, is defined by cylinder 23, since longitudinal end 26 of rod 21 is gripped inside fastening seat 24 and therefore connected integrally by rod 18 to lamp-holder 6.

Device 1 operates as follows.

Conducting rod 18 and rod 21 are slid axially inside sliding seat 25 and fastening seat 24 respectively of cylinder 23, which is located close to lamp-holder 6 and outside cap 34; rod 21 is also fixed to supporting body 5; and conducting rod 18 and electric cable 19 are connected to lamp-holder 6 and to electric components 11. To alter the spatial configuration of lighting fixture 3—in particular, the position of lamp-holder 6 with respect to supporting body 5—longitudinal end 26 of rod 21 need simply be slid inside fastening seat 24 to selectively adjust the distance between attachments 16 and 17. Since rod 18 is secured at both opposite ends 31 and 36, any change in the length of rod 21 between attachments 16 and 17 results accordingly in elastic deformation of both rods 18, 21, which, being flexible, assume specific curved configurations (one of which is shown in FIG. 1) corresponding to respective different positions of lamp-holder 6 with respect to supporting body 5.

Clearly, changes may be made to the device as described and illustrated herein without, however, departing from the scope of the present invention.

What is claimed is:

1. An adjustable device for supporting a lighting element of a lighting fixture, comprising a supporting body; a lamp-holder; mechanical connecting means for connecting the lamp-holder to the supporting body, and having respective attachments for connection to the lamp-holder and the supporting body; and first and second conducting means between the lamp-holder and the supporting body; wherein said first conducting means comprise a flexible conducting first rod, and said second conducting means are wire conducting means; and further comprising adjusting means for adjusting the length of said mechanical connecting means to selectively adjust the distance between said respective attachments and, therefore, the position of the lamp-holder with respect to the supporting body.

2. A device as claimed in claim 1, wherein said adjusting means comprise a fastening seat for housing and through which slide said mechanical connecting means; and gripping means for securing said mechanical connecting means (7) inside said fastening seat.

3. A device as claimed in claim 2, wherein said mechanical connecting means comprise a flexible second rod and said adjusting means comprise fastening means for fastening said first rod to said second rod.

4. A device as claimed in claim 3, wherein said fastening means comprise a cylinder having parallel radial through holes respectively defining said fastening seat for said second rod and a sliding seat for said first rod; and a threaded pin for gripping said second rod inside said fastening seat.

5. A device as claimed in claim 1, wherein said first and second conducting means comprise respective connecting ends for connection to said lamp-holder; the device further comprising electric insulating means surrounding said respective connecting ends.

6. A device as claimed in claim 5, wherein said electric insulating means comprise an insulating sleeve comprised of a polymer material; the device further including a cap fitted radially outwards to said lamp-holder and having an inner seat for housing said insulating sleeve.

* * * * *